US011033123B2

(12) United States Patent
Helseth et al.

(10) Patent No.: US 11,033,123 B2
(45) **Date of Patent: *Jun. 15, 2021**

(54) TWIST-TIE DISPENSER

(71) Applicant: Twist-Ease, Inc., Crystal, MN (US)

(72) Inventors: James R. Helseth, Plymouth, MN (US); Jeffrey Michael Helseth, Minneapolis, MN (US); Matthew James Helseth, Plymouth, MN (US); David J. Benson, Eagan, MN (US)

(73) Assignee: Twist-Ease, Inc., Crystal, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/751,697

(22) Filed: Jan. 24, 2020

(65) Prior Publication Data

US 2020/0229619 A1 Jul. 23, 2020

Related U.S. Application Data

(63) Continuation of application No. 15/299,586, filed on Oct. 21, 2016, now Pat. No. 10,542,830.
(Continued)

(51) Int. Cl.

| | |
|---|---|
| ***A47F 13/00*** | (2006.01) |
| ***B65D 83/02*** | (2006.01) |
| ***B65D 73/00*** | (2006.01) |

(52) U.S. Cl.
CPC ..... *A47F 13/00* (2013.01); *B65D 73/0014* (2013.01); *B65D 73/0021* (2013.01); *B65D 73/0028* (2013.01); *B65D 83/02* (2013.01)

(58) Field of Classification Search
CPC ..... A47F 13/00; A47F 5/006; A47F 7/143; B65D 73/0014; B65D 73/0021;
(Continued)

(56) References Cited

U.S. PATENT DOCUMENTS

| | | | |
|---|---|---|---|
| 628,642 | A | 7/1899 | Wyman |
| 740,001 | A | 9/1903 | Flanagin |

(Continued)

OTHER PUBLICATIONS

International Search Report and Written Opinion for International Application No. PCT/US2016/058195 dated Jan. 25, 2017 (14 pgs).

*Primary Examiner* — Christopher Garft
(74) *Attorney, Agent, or Firm* — Merchant & Gould P.C.

(57) ABSTRACT

A twist-tie dispenser comprises a twist-tie cluster and a base. The base includes a top portion, a rear wall extending downward from the top portion, and an open front. A latching structure for removably mounting the base to a fixture is defined at least in part by a first hook-like extension protruding from the rear wall of the base, the first hook-like extension defining a pocket formed by an upper stop surface and a vertical retention surface, the latching structure also defined at least in part by a flexible portion of the rear wall that is configured to elastically deflect through a cut-out provided on the rear wall in a direction from the rear wall toward the open front when a rod-like mounting structure of the fixture is inserted into the pocket of the first hook-like extension, the flexible portion also defining a lower stop surface that opposes the upper stop surface of the first hook-like extension when the rod-like mounting structure is within the pocket and is captured between the lower stop surface and the upper stop surface.

23 Claims, 15 Drawing Sheets

Related U.S. Application Data

(60) Provisional application No. 62/245,655, filed on Oct. 23, 2015.

(58) Field of Classification Search
CPC .... B65D 73/0028; B65D 25/20; B65D 25/22; B42F 1/06; F16B 2/20
See application file for complete search history.

(56) References Cited

U.S. PATENT DOCUMENTS 1,441,359 A 1/1923 Langston
2,050,394 A 8/1936 Straubel
D156,922 S 1/1950 Sonntag
2,973,597 A 3/1961 Powell
2,984,161 A 5/1961 Cook et al.
3,068,135 A 12/1962 Bower
3,207,564 A 9/1965 Patrick et al.
3,290,854 A 12/1966 MacMurray
3,409,948 A 11/1968 Goodwin
3,774,755 A 11/1973 Cast et al.
4,052,886 A 10/1977 Buick
D261,452 S 10/1981 Chandler
4,340,144 A * 7/1982 Cousins ..... A47F 5/083 211/106
4,509,231 A 4/1985 Paxton
4,529,636 A * 7/1985 Olson ..... B65D 63/10 206/344
4,537,330 A 8/1985 Gelbard
4,543,862 A 10/1985 Levene et al.
4,558,813 A 12/1985 Richards
4,596,195 A 6/1986 Wenger
D285,719 S 9/1986 Conlon
4,621,732 A * 11/1986 Olson ..... B65D 63/10 206/343
D294,908 S 3/1988 Childress
4,815,610 A 3/1989 Borick et al.
4,842,230 A * 6/1989 Cobb ..... A47F 5/083 211/106
4,948,202 A 8/1990 Helseth
D323,594 S 2/1992 Helseth
5,092,830 A 3/1992 Helseth
5,213,400 A 5/1993 Helseth
5,232,431 A 8/1993 Helseth
5,579,971 A * 12/1996 Chuang ..... B62J 7/04 224/430
D395,566 S 6/1998 Helseth
5,871,115 A 2/1999 Kohn
5,961,434 A 10/1999 Helseth
6,217,500 B1 4/2001 Helseth et al.
8,292,139 B2 * 10/2012 Golub ..... B62J 7/08 224/419
9,186,038 B2 * 11/2015 Bastuji ..... A47L 15/502
9,737,141 B2 * 8/2017 Johnson ..... B25H 3/06
2003/0000905 A1 * 1/2003 Zidek ..... A47F 5/01 211/205
2008/0041901 A1 * 2/2008 Chuang ..... B62J 9/20 224/430
2012/0062085 A1 * 3/2012 Bastuji ..... A47L 15/502 312/228.1
2015/0034513 A1 2/2015 Helseth
2017/0129670 A1 * 5/2017 Milbrandt ..... A47F 13/00

* cited by examiner

TWIST-TIE DISPENSER

CROSS-REFERENCE TO RELATED APPLICATIONS

The present application is a continuation of U.S. patent application Ser. No. 15/299,586, filed Oct. 21, 2016, now U.S. Pat. No. 10,542,830; which claims priority to U.S. Provisional Application Ser. No. 62/245,655, filed Oct. 23, 2015, which applications are incorporated herein by reference in their entireties.

FIELD

The present disclosure relates generally to twist-tie dispensers and methods of use.

BACKGROUND

There are many uses for twist-ties. In a grocery store, for example, consumers commonly place produce items, bakery items, bulk food items, and the like in bags and use twist-ties to temporarily close the bags. In such uses, sanitary conditions are very important and, therefore, consideration should be given to the manner in which the twist-ties are dispensed. Further, spillage of twist-ties is a concern for safety reasons among others. Quick and cost-effective refill or replacement of the twist-ties or the dispensers thereof is also advantageous.

For the reasons stated above and for other reasons stated below, which will become apparent to those skilled in the art upon reading and understanding the present specification, there is a need in the art for an improved twist-tie dispenser.

SUMMARY

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, the twist-tie dispenser is configured as a disposable product, wherein the dispenser can be thrown away or disposed of once the twist-tie cluster is spent. The twist-tie dispenser comprises a base and a twist-tie cluster attached to the base. The base includes a top portion, which may be generally U-shaped and form a pocket that is for receiving the twist-tie cluster. The base also includes a rear portion or wall that defines mounting members used for mounting the base to a fixture.

According to one example embodiment, the mounting members may be defined by hook-like extensions that protrude from the rear wall of the base, wherein the hook-like extensions are configured to receive elongate, rod-like mounting structures of a fixture to which the disposable twist-tie dispenser is to be mounted. According to one example, the hook-like extensions may fit over the elongate, rod-like mounting structures of the fixture. In addition to the hook-like extensions, the rear wall of the base may define a flexible portion that is used for latching and unlatching the dispenser to the fixture.

The flexible portion acts as a cantilever. In some embodiments, the flexible portion defines ramped tabs with latching surfaces that oppose and cooperate with upper stop surfaces formed by the hook-like extensions for latching the dispenser to the fixture. When the twist-tie cluster is spent and the dispenser needs to be removed and replaced, the flexible portion may be elastically flexed toward the front of the dispenser to clear the latching surfaces from the rod-like mounting structures of the fixture. In this manner, the dispenser can be lifted off the fixture.

According to another aspect of the disclosure, a twist-tie dispenser comprises a base including a top portion defining a twist-tie cluster mounting surface, a rear wall extending downward from the top portion, and an open front. A latching structure configured for removably mounting the base to a fixture including at least one rod-like mounting structure is defined at least in part by a first hook-like extension protruding from the rear wall of the base, the first hook-like extension defining a pocket formed by an upper stop surface and a vertical retention surface, the latching structure also defined at least in part by a flexible portion of the rear wall that is configured to elastically deflect through a cut-out provided on the rear wall in a direction from the rear wall toward the open front when the rod-like mounting structure of the fixture is inserted into the pocket of the first hook-like extension, the flexible portion also defining a lower stop surface that opposes the upper stop surface of the first hook-like extension when the rod-like mounting structure is within the pocket of the first hook-like extension and is captured between the lower stop surface and the upper stop surface. As seen in FIG. 1, the cutout extends, vertically, past the center point of the rear wall and to a point that is positioned above the hook-like extensions (36). The cutout, shown in FIG. 1, defined the flexible portion (48) of the rear wall, where the flexible portion can elastically deflect through the cutout in a direction from the rear wall toward the open front defined by the base of the twist-tie dispenser. The cutout is shown as or is represented by slots that are positioned at both sides of the flexible portion (48) of the real wall as shown in FIG. 1.

According to another aspect of the disclosure, the twist-tie dispenser includes the twist-tie cluster integrally mounted to the top portion of the base, and the dispenser including the twist-tie cluster is mounted and removed from the fixture as an integral disposable unit.

According to yet another aspect, the disclosure is directed to a method of using a twist-tie dispenser, the method comprising providing a twist-tie dispenser comprising a base including a top portion defining a twist-tie cluster mounting surface, a rear wall extending downward from the top portion, and an open front, the dispenser further comprising a latching structure configured for removably mounting the base to a fixture including at least one rod-like mounting structure, the latching structure defined at least in part by a first hook-like extension protruding from the rear wall of the base, the first hook-like extension defining a pocket formed by an upper stop surface and a vertical retention surface, the latching structure also defined at least in part by a flexible portion of the rear wall that is configured to elastically deflect through a cut-out provided on the rear wall in a direction from the rear wall toward the open front when the rod-like mounting structure of the fixture is inserted into the pocket of the first hook-like extension, the flexible portion also defining a lower stop surface that opposes the upper stop surface of the first hook-like extension when the rod-like mounting structure is within the pocket and is captured between the lower stop surface and the upper stop surface, slidably inserting the rod-like structure of the fixture into the pocket of the first hook-like extension until abutting the upper stop surface, and while slidably inserting the rod-like structure of the fixture into the pocket of the first hook-like extension, deflecting the flexible portion of the rear wall through the cut-out provided on the rear wall until the rod-like structure is captured between the upper stop surface of the first hook-like extension and the lower stop surface defined by the flexible portion.

The method may further comprise removing the twist-tie dispenser from the fixture by re-deflecting the flexible portion toward the open front through the cut-out provided on the rear wall until the rod-like structure clears the lower stop surface and slidably lifting the base upward relative to the fixture.

BRIEF DESCRIPTION OF THE DRAWINGS

The inventive aspects of the present disclosure can be more easily understood, and further advantages and uses thereof can be more readily apparent, when considered in view of the detailed description and the following Figures in which.

In accordance with common practice, the various described features are not drawn to scale but are drawn to emphasize specific inventive features relevant to the present disclosure. Reference characters denote like elements throughout the Figures and the text.

DETAILED DESCRIPTION

In the following detailed description, reference is made to the accompanying drawings, which form a part hereof, and in which is shown by way of illustration, embodiments in which the inventions may be practiced. These embodiments are described in sufficient detail to enable those skilled in the art to practice the inventive features, and it is to be understood that other embodiments may be utilized and mechanical changes may be made without departing from the spirit and scope of the present disclosure. The following detailed description is, therefore, not to be taken in a limiting sense, and the scope of the present inventive features are defined only by the claims and equivalents thereof.

Embodiments of the present disclosure provide improved twist-tie dispensers.

Figure 15:
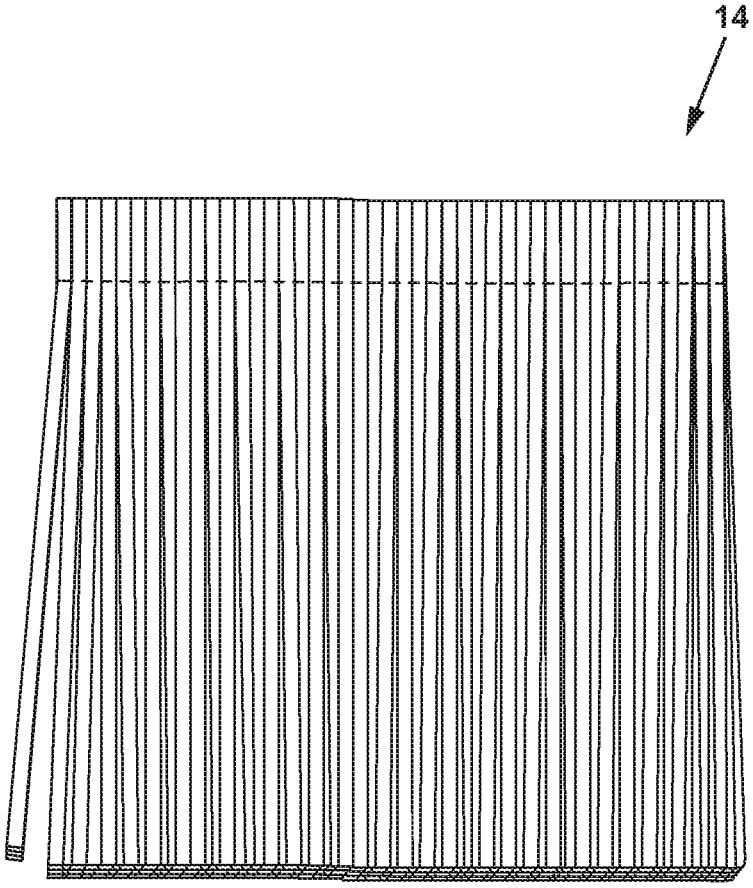
FIG. 15 illustrates an example of a twist-tie cluster configured to be fixed to any of the dispensers shown in FIGS. 1-14.

According to one embodiment, the twist-tie dispenser 10 is configured as a disposable device, wherein the entire dispenser 10 can be removed from a fixture 12 at a customer location such as a grocery store and thrown away or disposed of once a twist-tie cluster 14 is spent. In such an embodiment, the twist-tie cluster 14 may be provided with/attached to the dispenser 10 as an integral unit. The twist-tie cluster 14 may be attached to the dispenser 10 in a variety of ways known in the art including via adhesives. Once the twist-ties of the cluster 14 are used and the entire cluster 14 is spent, the entire dispenser 10, along with the portion of the cluster 14 that has adhesively been attached to the dispenser 10, can be disposed. An example of a twist-tie cluster 14 that can be fixed to any of the dispensers discussed in the present application is shown in FIG. 15.

Figure 1:
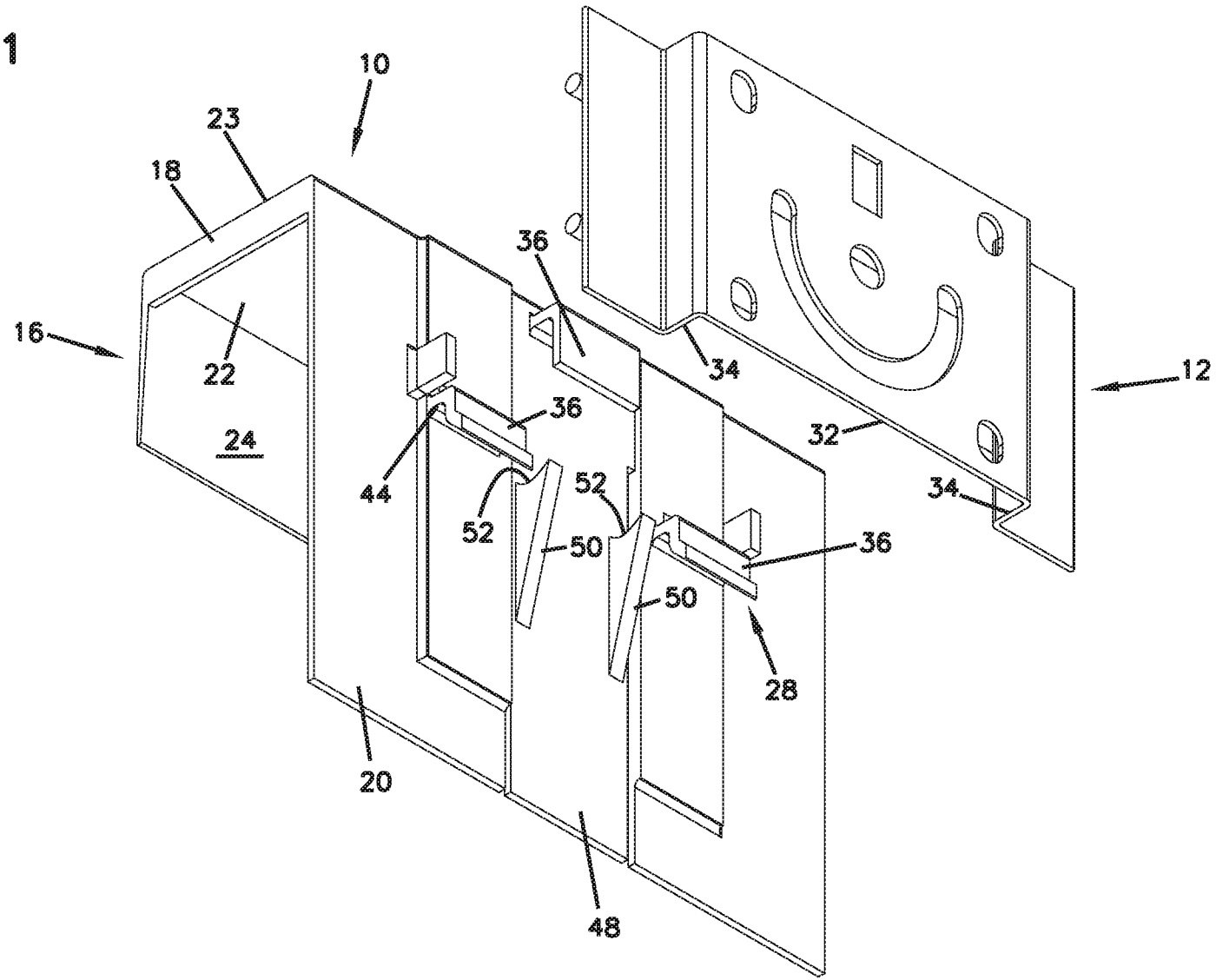
FIG. 1 is a rear perspective view of a base of a twist-tie dispenser having features that are examples of inventive aspects in accordance with the present disclosure, the twist-tie dispenser shown with a fixture to which the dispenser may be attached.
Figure 2:
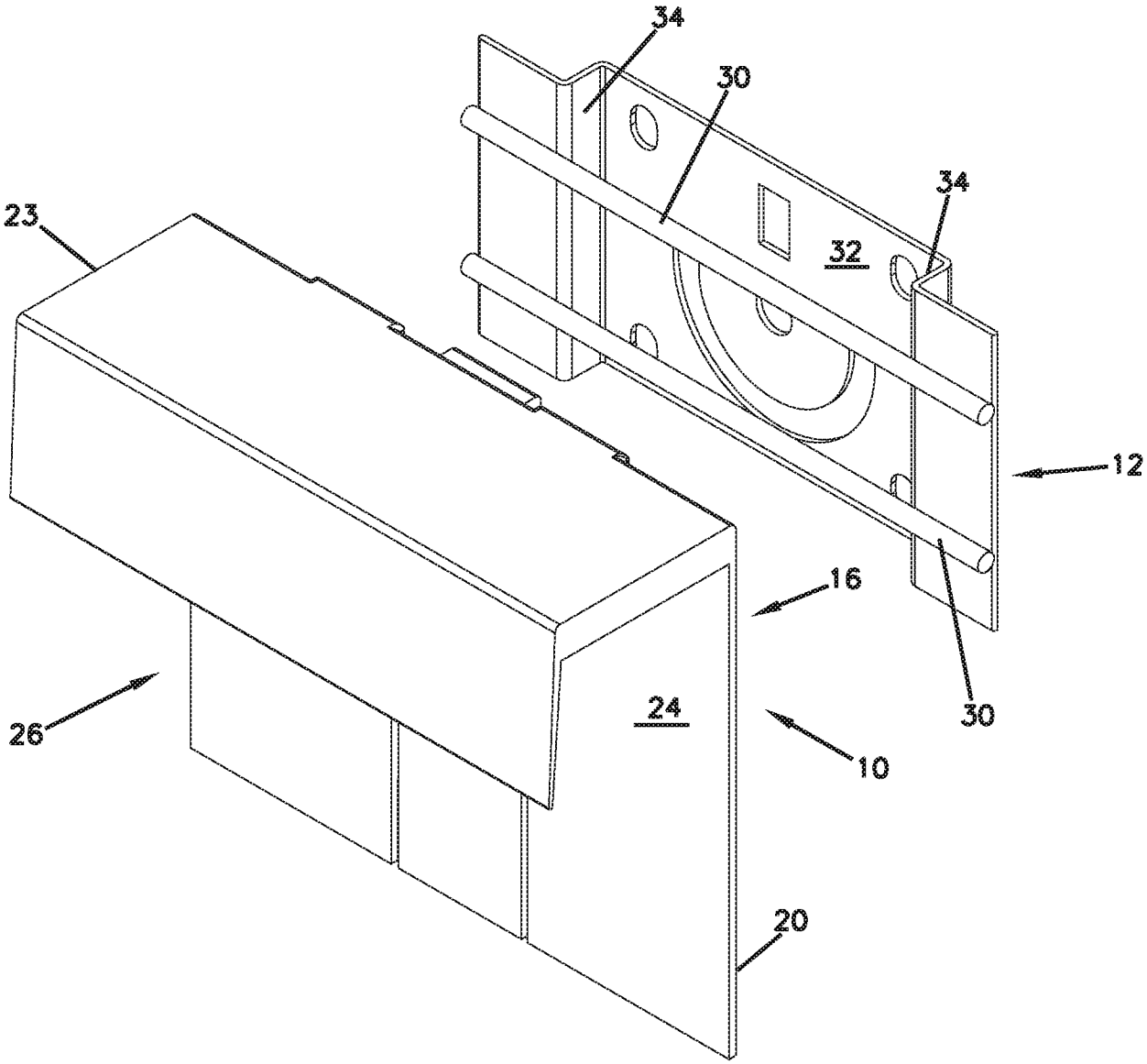
FIG. 2 is a front perspective view of the base of the twist-tie dispenser and fixture of FIG. 1.
Figure 3:
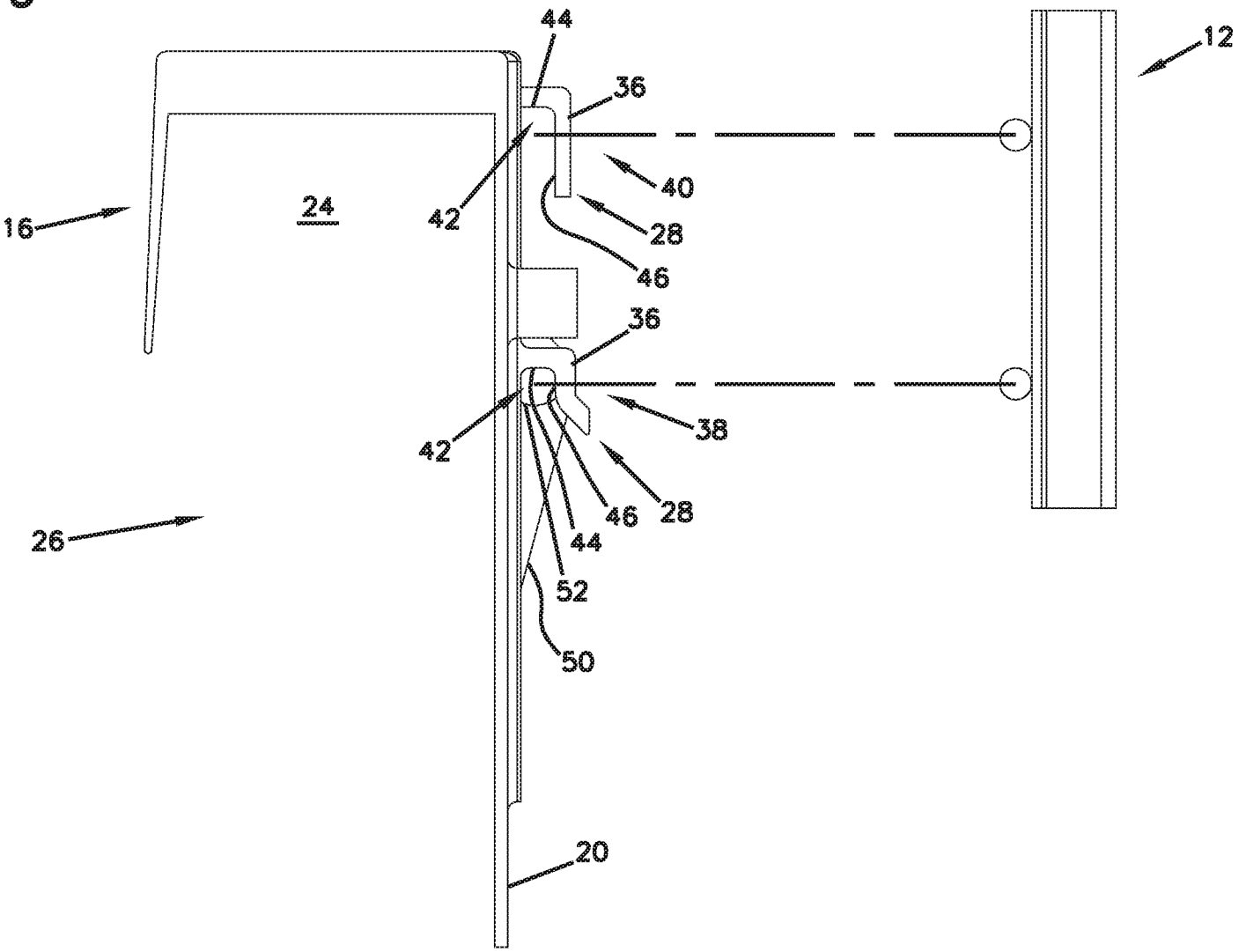
FIG. 3 is a side view of the base of the twist-tie dispenser and fixture of FIG. 1.
Figure 4:
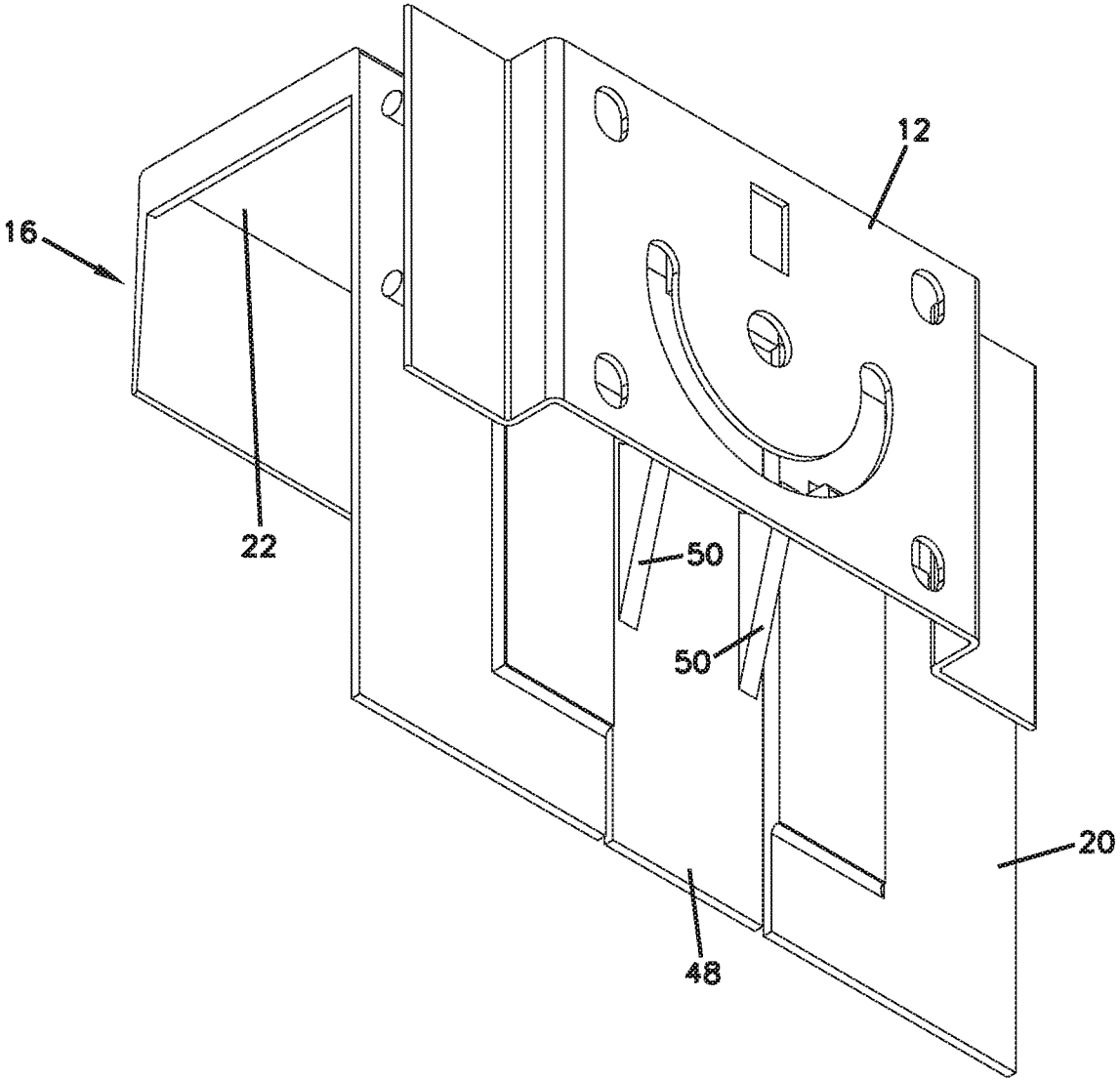
FIG. 4 illustrates a rear perspective view of the twist-tie dispenser of FIGS. 1-3 mounted on the fixture of FIGS. 1-3.
Figure 5:
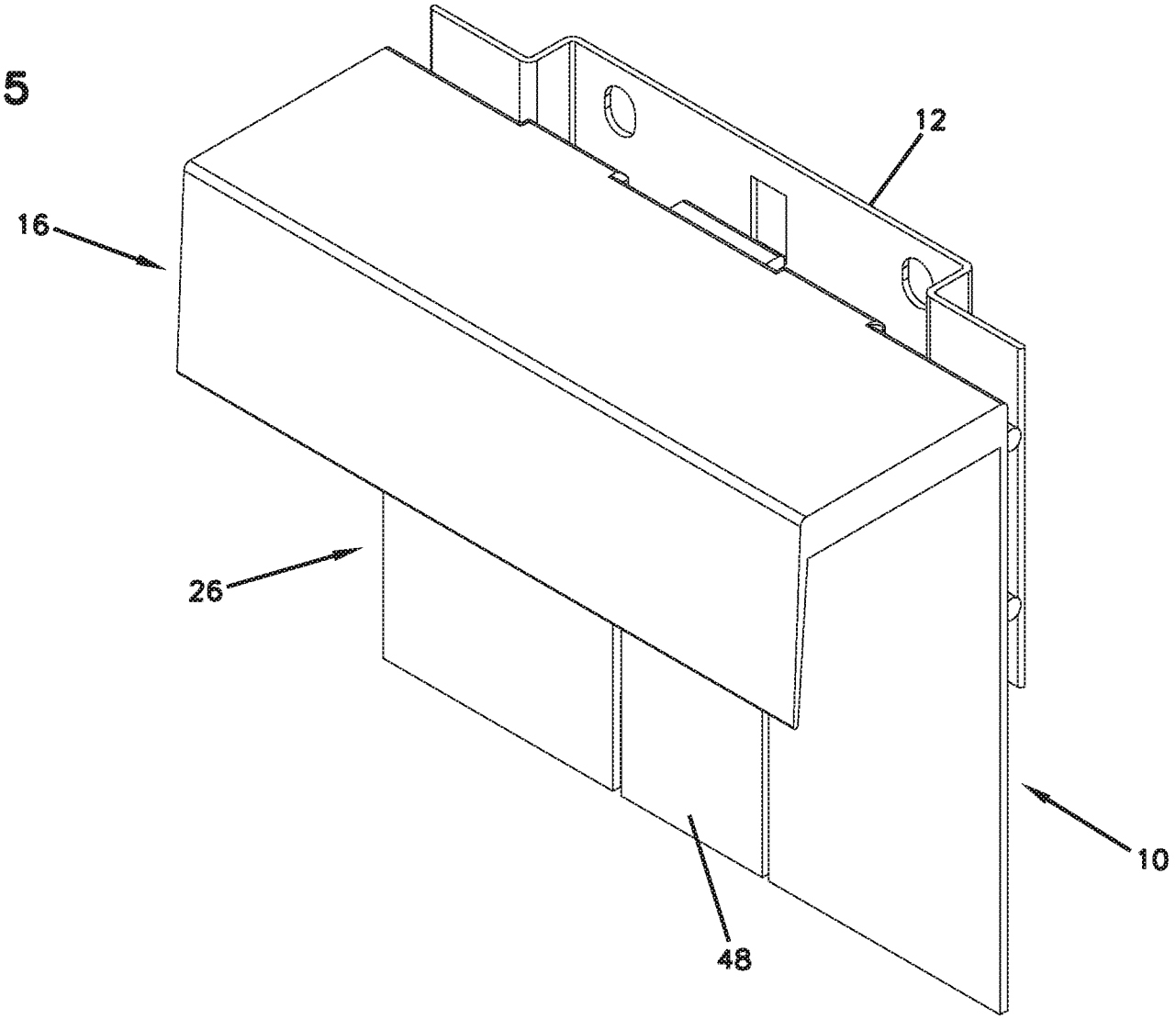
FIG. 5 is a front perspective view of the twist-tie dispenser mounted on the fixture of FIG. 4.
Figure 6:
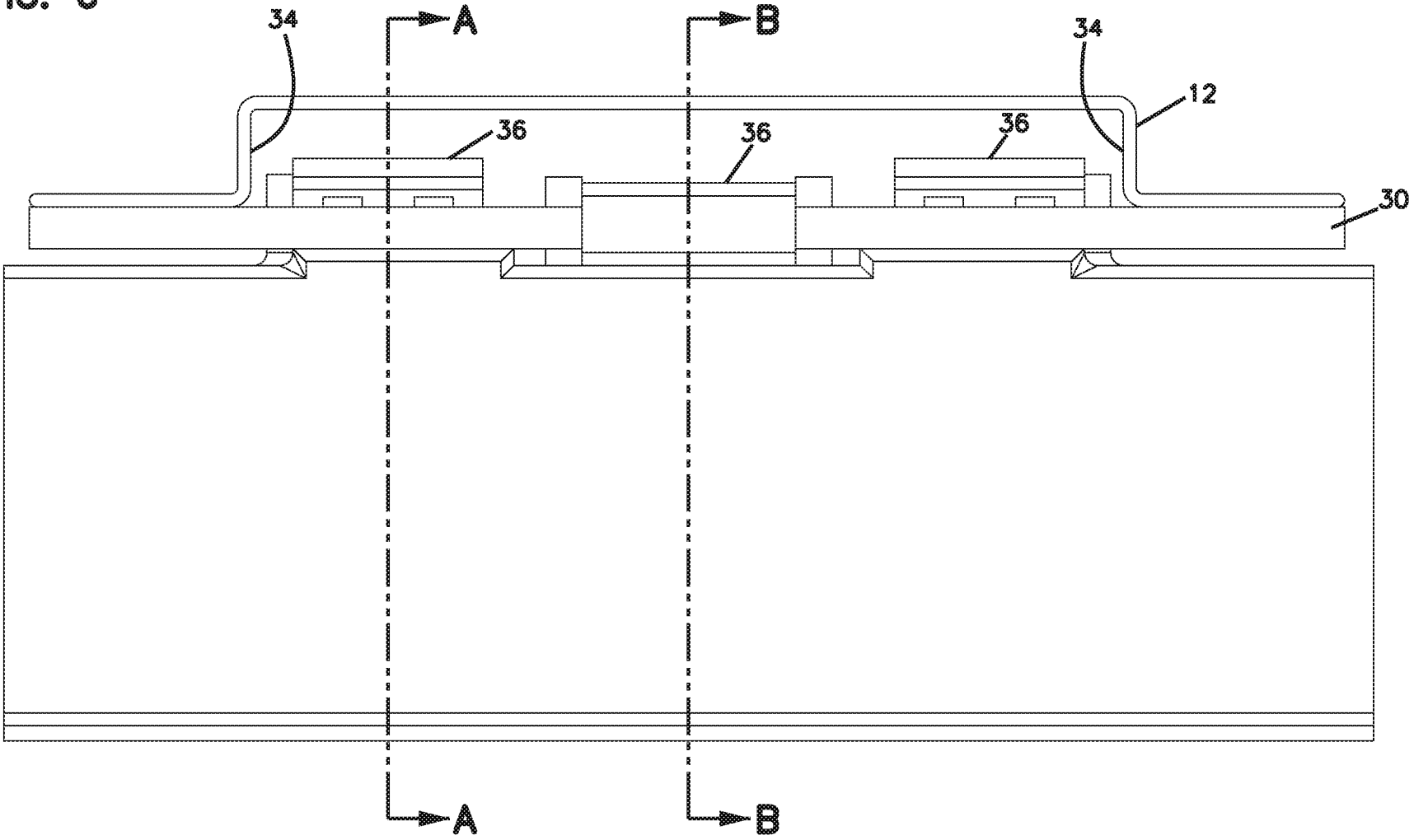
FIG. 6 is a top view of the twist-tie dispenser mounted on the fixture of FIG. 4.
Figure 7:
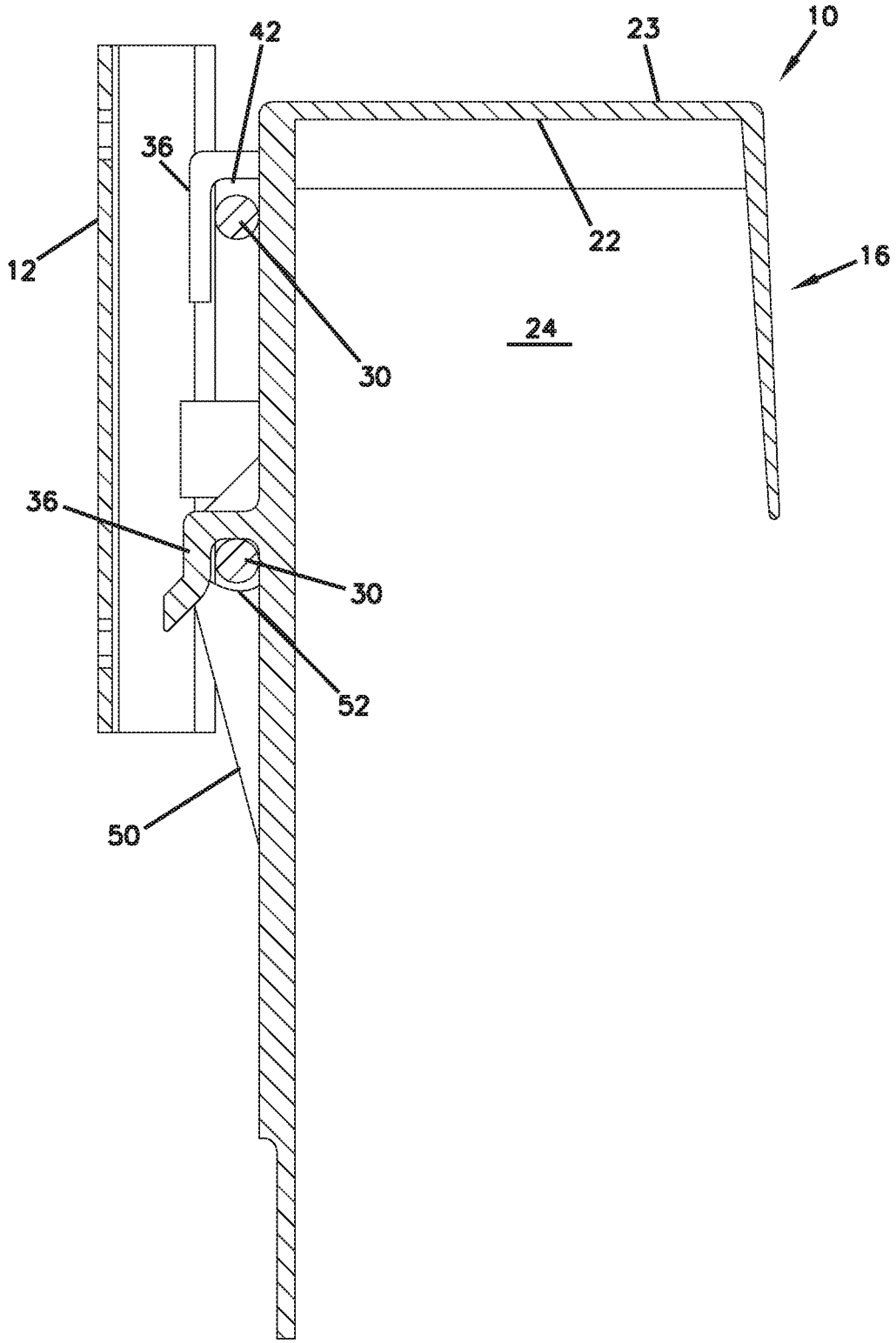
FIG. 7 is a cross-section taken along line A-A of FIG. 6.
Figure 8:
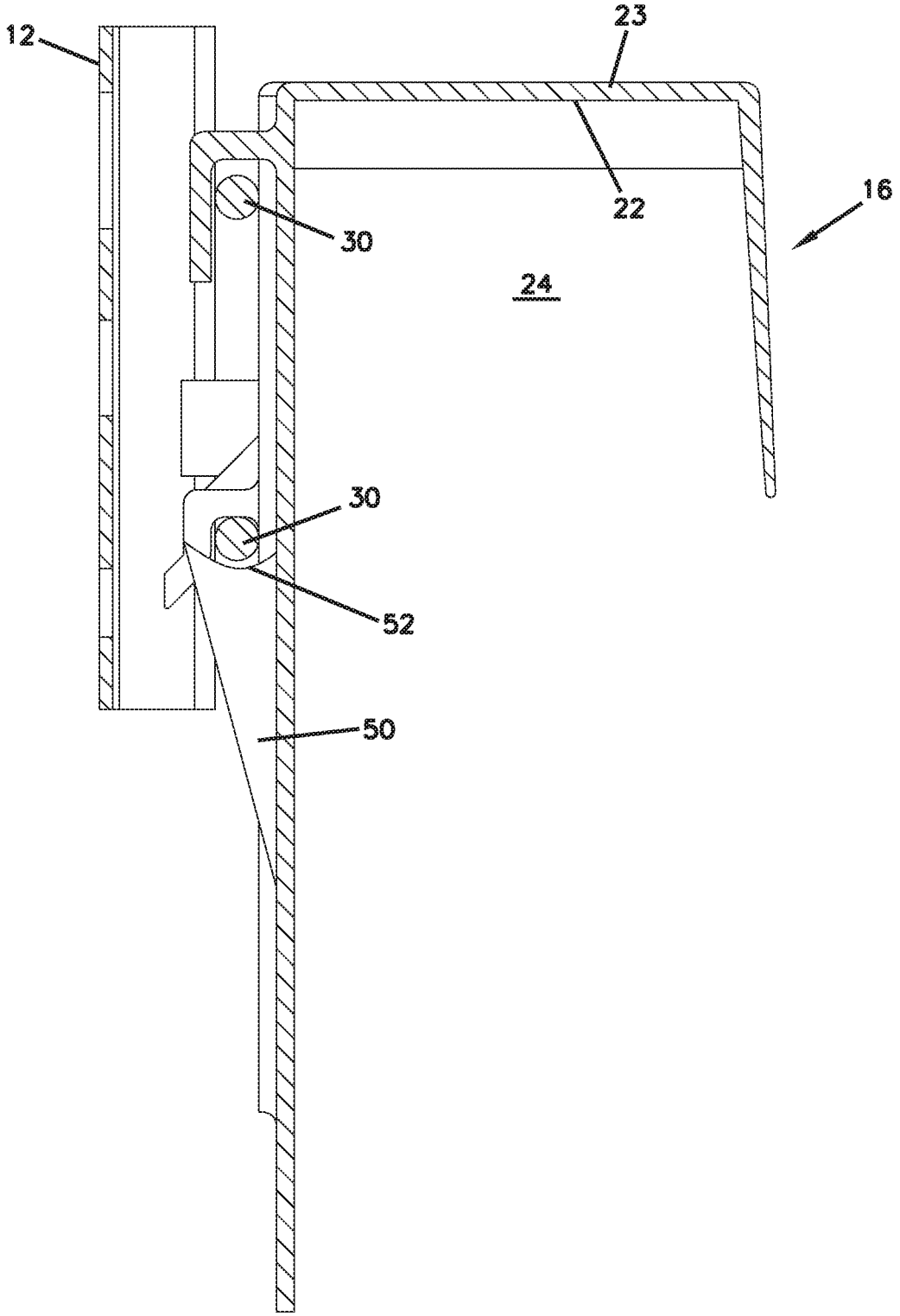
FIG. 8 is a cross-section taken along line B-B of FIG. 6.

Referring to FIGS. 1-8, one embodiment of the twist-tie dispenser 10 includes a base 16 that is used for mounting the dispenser 10 to a fixture 12 at, for example, a grocery store. In FIGS. 1-3, the dispenser 10 is shown separately from the fixture 12, and in FIGS. 4-8, the dispenser 10 is shown mounted on the fixture 12.

As shown in FIGS. 1-8, the base 16 may include a generally U-shaped top portion 18 and a rear portion or wall 20. The rear wall 20 extends downward from the top portion 18. As will be discussed in further detail below, the U-shaped top portion 18 is configured for receiving a twist-tie cluster 14, while the rear wall 20 is configured for removably attaching the base 16 to a fixture 12.

The base 16 could be made of extruded plastic and optionally be at least partially covered with paper, which could include graphics such as logos, trademarks, advertising, and the like.

The twist-tie cluster 14 that is provided as part of the dispenser 10 may include a plurality of twist-ties that are attached to a mounting surface 22 defined by the top portion 18 of the base 16 via, for example, adhesive. Other methods of attaching the twist-tie cluster 14 to the base 16 are also contemplated. For example, the base 16 and the twist-tie cluster 14 may be secured with a securing member selected from the group consisting of an adhesive, at least one staple, and at least one rivet.

In assembling the dispenser 10, a top portion of the twist-tie cluster 14 is received by a pocket 24 formed by the U-shaped top portion 18 of the base 16. The top portion of the cluster 14 is adhered to an inside mounting surface 22 of a top wall 23 of the U-shaped top portion 18 of the base 16. A bottom portion of the twist-tie cluster 14, which is formed from a plurality of separated twist-ties, hangs down from the U-shaped top portion 18 of the base 16 and is exposed to the users from an open front 26 of the base 16. A user can tear off one of the twist-ties by accessing it from the open front 26.

As noted above, rather than simply refilling the twist-tie cluster 14, the dispenser 10 of the present disclosure includes a base 16 that is in effect integral with a twist-tie cluster 14. This has numerous benefits including provision of biodegradable components, lower cost by elimination of a heavy plastic receiver, cleaner appearance of the base 16 due to periodic disposal and replacement with a new base 16, the ability to match advertising on the base 16 with advertising on the twist-ties, etc.

Now referring to FIGS. 1 and 6-8, the rear portion or wall 20 of the base 16 that includes mounting features 28 for removably mounting the base 16 to a fixture 12 is described. It should be noted, as will be described, that the mounting features 28 are configured for mounting and unmounting the base 16 to and from a specific fixture 12 that is generally provided at the user venues, such as grocery stores. As noted above, such a fixture 12 is illustrated in FIGS. 1-8. The example fixture 12 shown in FIGS. 1-8 includes two parallel rod-like mounting structures 30. As will be discussed, the mounting features 28 of the base 16 may be configured and arranged to cooperate with and match the spacing of the rod-like structures 30. Even though shown as including two parallel rod-like mounting structures 30, more or fewer rod-like mounting structures 30 may be provided on the fixture 12, and the dispenser 10 of the present disclosure may be used with more or fewer rod-like mounting structures 30. According to one example embodiment, the rod-like structures 30 may be 3/16" in diameter and the spacing between the two rows of the rod-like mounting structures 30 may be 1¼".

As shown in FIGS. 1-8, the fixture 12 may also define an inset dispenser mounting area 32 (across which the rod-like structures 30 extend) that is bordered by sidewalls 34. The sidewalls 34 are configured to limit sideways movement of the dispenser 10 once the dispenser 10 has been mounted.

Still referring to FIGS. 1-8, the mounting feature 28 of the base 16 that cooperates with the rod-like structures 30 of the fixture 12 defines at least one extension 36. The extension 36 protrudes outwardly from the rear wall 20 of the base 16. The extension 36 defines a hook-like configuration and is configured to receive the elongate, rod-like mounting structures 30 of the fixture 12 to which the twist-tie dispenser 10 is to be mounted.

The at least one extension 36 can include a plurality of extensions 36 as shown in the depicted version of the base 16. In certain embodiments, the at least one extension 36 can include multiple rows of extensions 36 (as in the version shown) such that the twist-tie dispenser 10 can be mounted to a fixture 12 that has multiple parallel elongate rod-like mounting structures 30.

In the embodiment depicted in FIGS. 1-8, two extensions 36 are provided in an aligned but spaced-apart relationship defining a lower row 38, and a single extension 36 is provided thereabove defining an upper row 40.

According to the depicted embodiment, the hook-like configuration defined by each extension 36 defines a pocket 42 formed by an upper stop surface 44 and a vertical retention surface 46.

Still referring to FIGS. 1-8, in addition to the hook-like extensions 36, the mounting features 28 defined at the rear wall 20 of the base 16 may include a flexible portion 48 that is used for latching and unlatching the dispenser 10 to the fixture 12.

The flexible portion 48 acts as a cantilever. The flexible portion 48 may define at least one ramped tab 50. The ramped configuration of the tab 50 provides deflection to the flexible portion 48 as a rod-like structure 30 of the fixture 12 contacts the tab 50. The ramped tab 50 defines a latching surface 52 (also called a lower stop surface 52) that opposes and cooperates with the upper stop surface 44 formed by one of the hook-like extensions 36 for latching the dispenser 10 to the fixture 12. In the depicted version of the dispenser 10, the flexible portion 48 is provided at the center of the two extensions 36 of the lower row 38, and two ramped tabs 50 are provided on the flexible portion 48 of the base 16, each one configured to cooperate with a corresponding extension 36 on the lower row 38. As noted above, the ramps facilitate slidable latching of the dispenser 10 to the fixture 12. The rod-like mounting structures 30 of the fixture 12 can ride along the ramped tabs 50 and elastically deflect the flexible portion 48 as the rod-like mounting structures 30 enter the pockets 42 of the hook-like extensions 36.

When mounting the dispenser 10 to the fixture 12, the cantilevered flexible portion 48 is contacted and elastically flexed out of the way when receiving the elongate rod-like mounting structure 30 into the pockets 42 of the hook-like extensions 36. Once the rod 30 is passed over the ramped tab 50 of the cantilever 48 and enters the pocket 42 to abut the upper stop surface 44, the cantilever 48 flexes back to its original position. The latching or lower stop surfaces 52 of the ramped tabs 50 are configured to cooperate with the upper stop surfaces 44 of the extensions 36 to capture and prevent or limit removal of the rod 30 from the base 16 of the twist-tie dispenser 10.

When the twist-tie cluster 14 is spent and the dispenser 10 needs to be removed and replaced, the flexible portion 48 may be elastically flexed toward the open front 26 of the dispenser base 16 to clear the latching surfaces 52 from the rod-like mounting structures 30 of the fixture 12. In this manner, the dispenser 10 can be lifted off the fixture 12.

The extension 36 provided at the upper row 40 provides stability to the base 16 when mounted on the fixture 12 by cooperating with the other rod-like mounting structure 30 of the fixture 12 that is parallel to the lower rod-like mounting structure 30. In certain embodiment, the upper extension 36 may not be needed.

Figure 9:
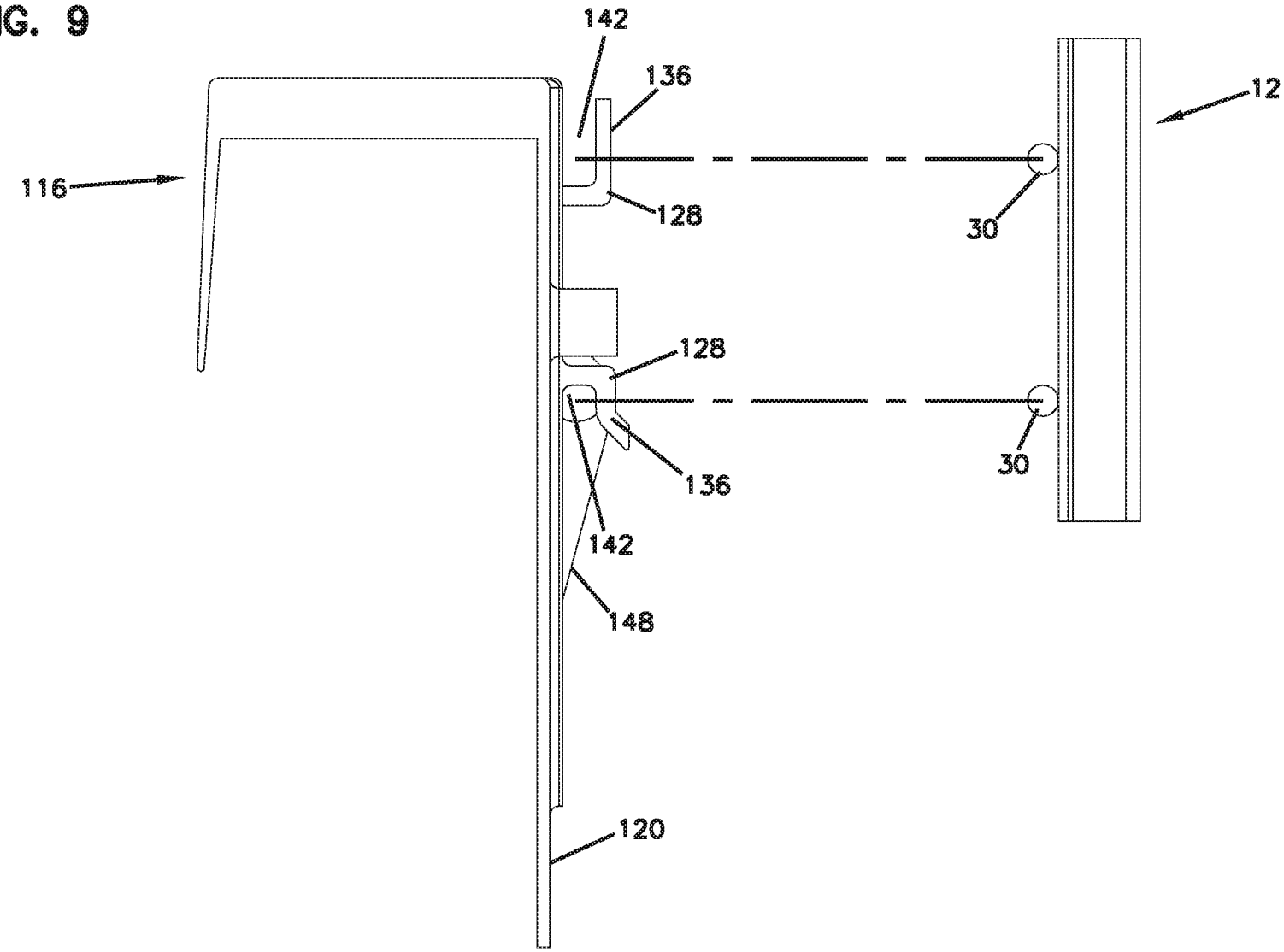
FIG. 9 illustrates a base of a twist-tie dispenser defining an alternative mounting arrangement.
Figure 10:
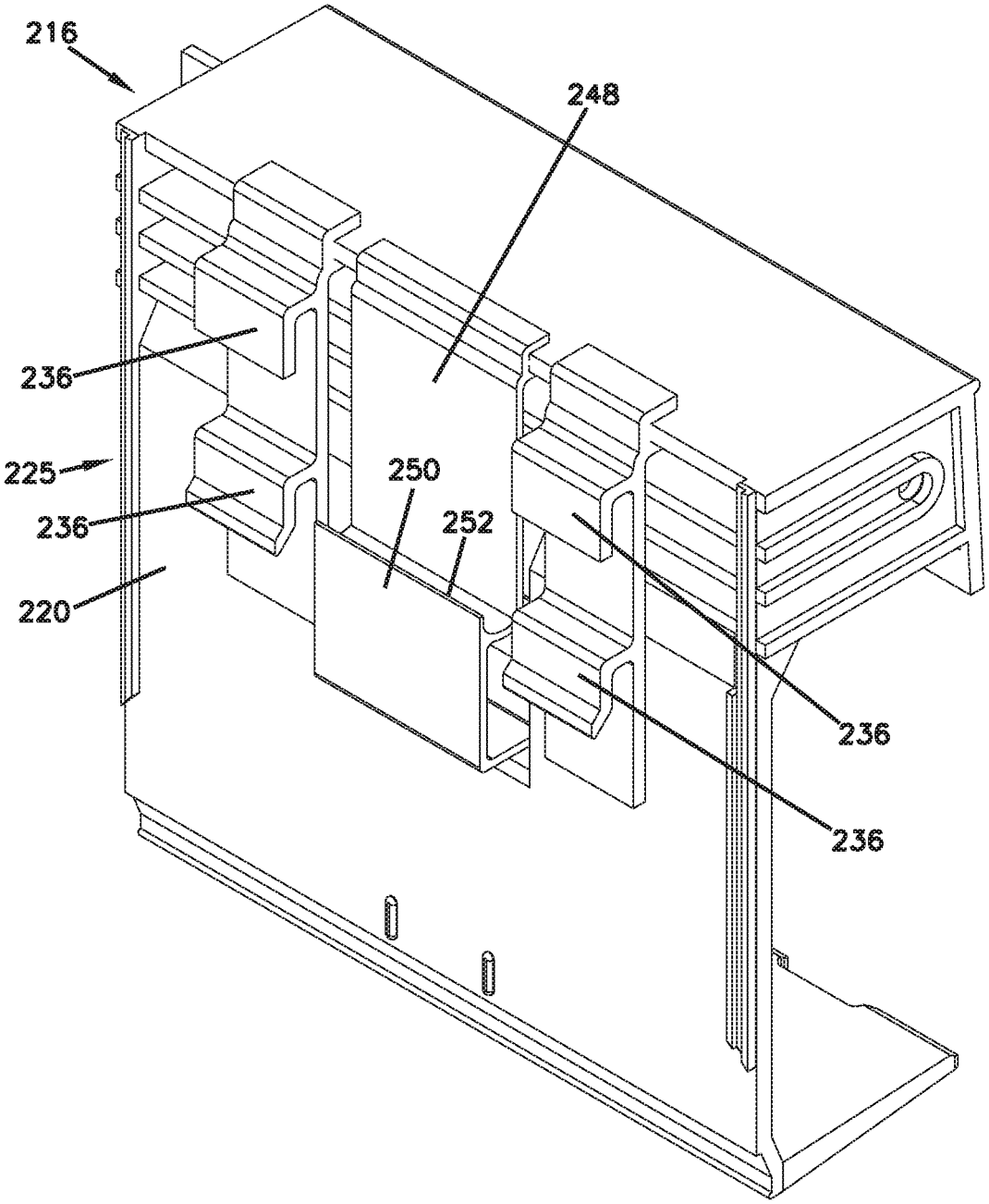
FIG. 10 is a rear perspective of another version of a base of a twist-tie dispenser defining yet another alternative mounting arrangement.
Figure 11:
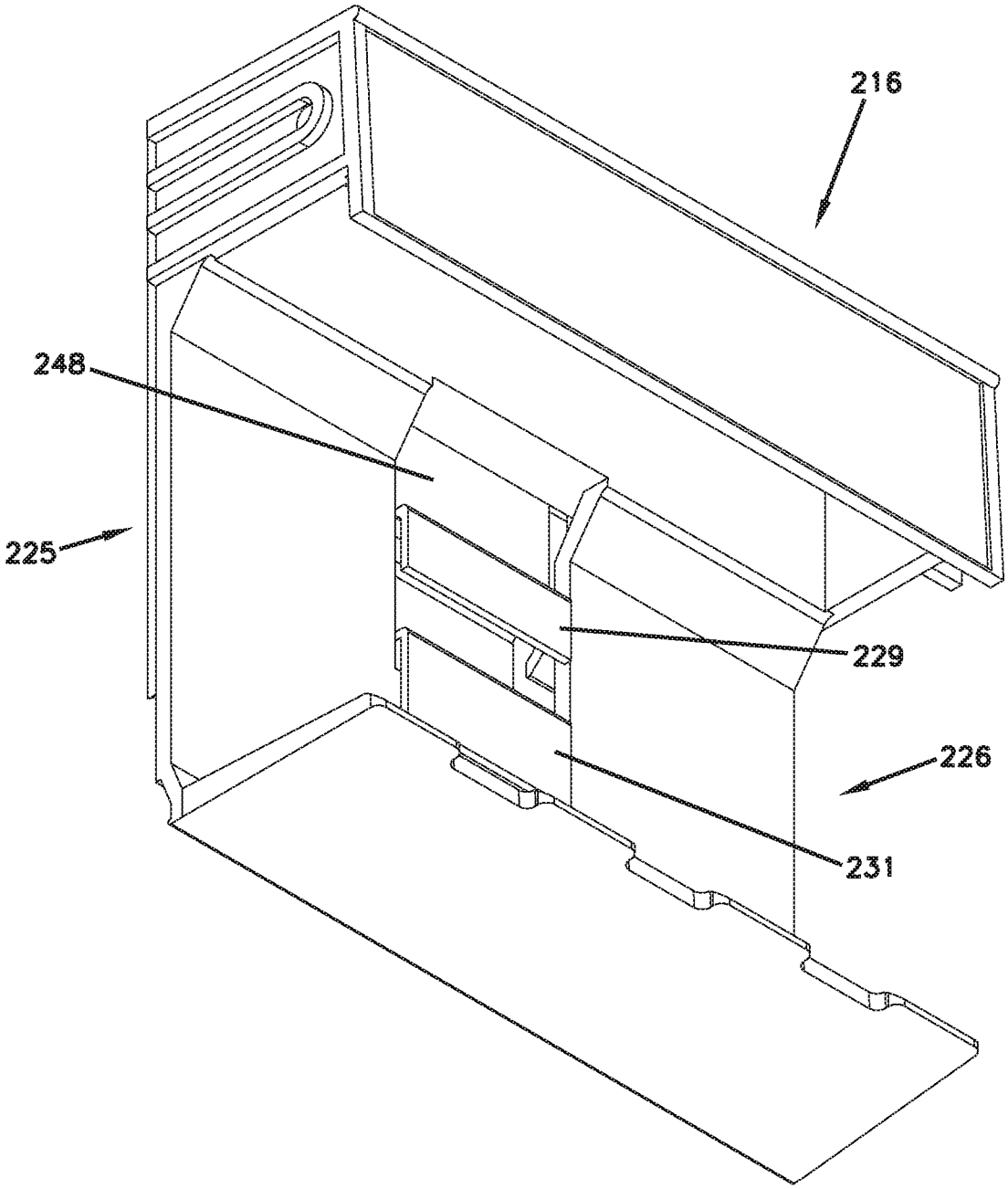
FIG. 11 is a front perspective view of the base of FIG. 10.
Figure 12:
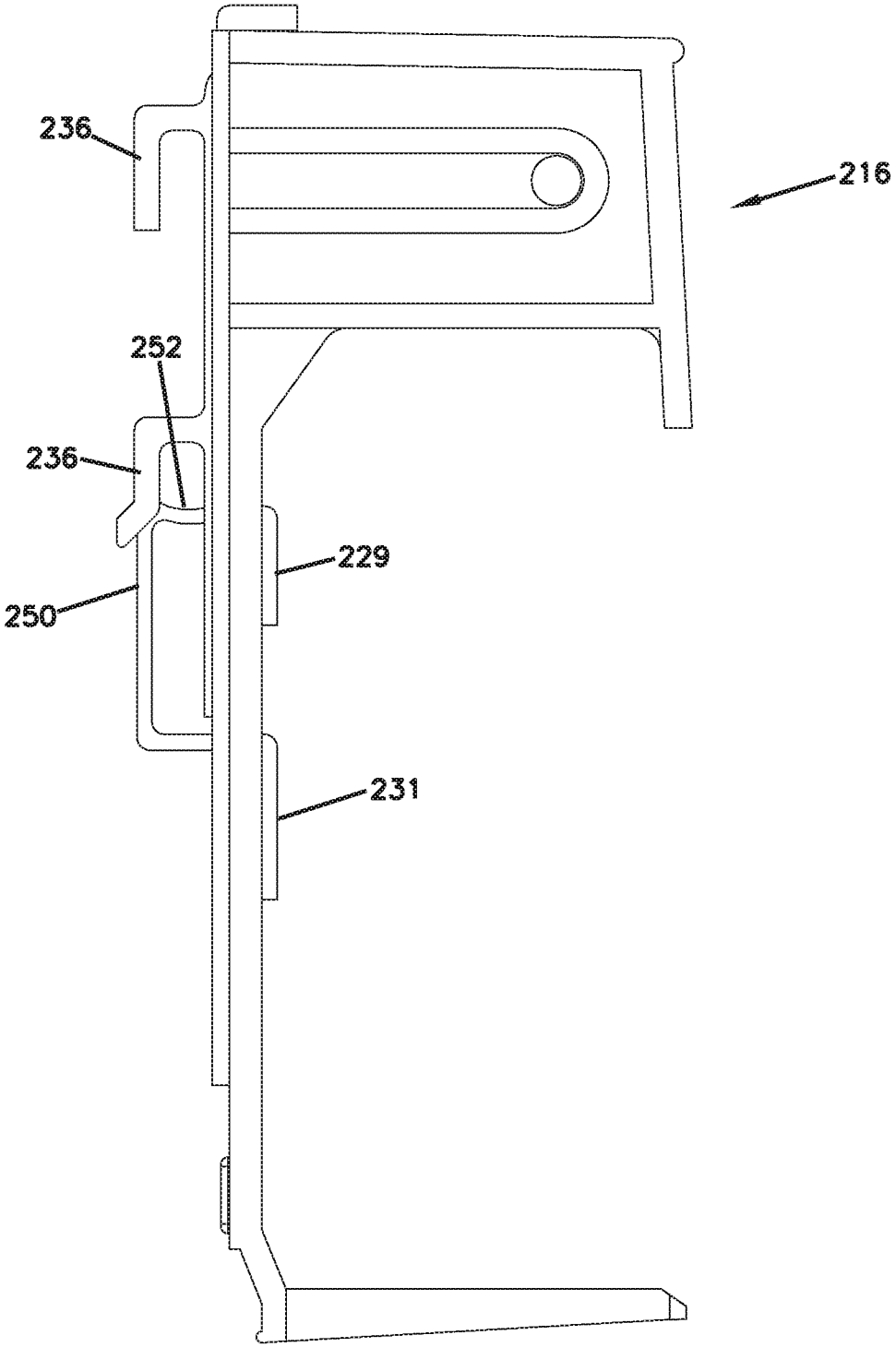
FIG. 12 is a side view of the base of FIG. 10.
Figure 13:
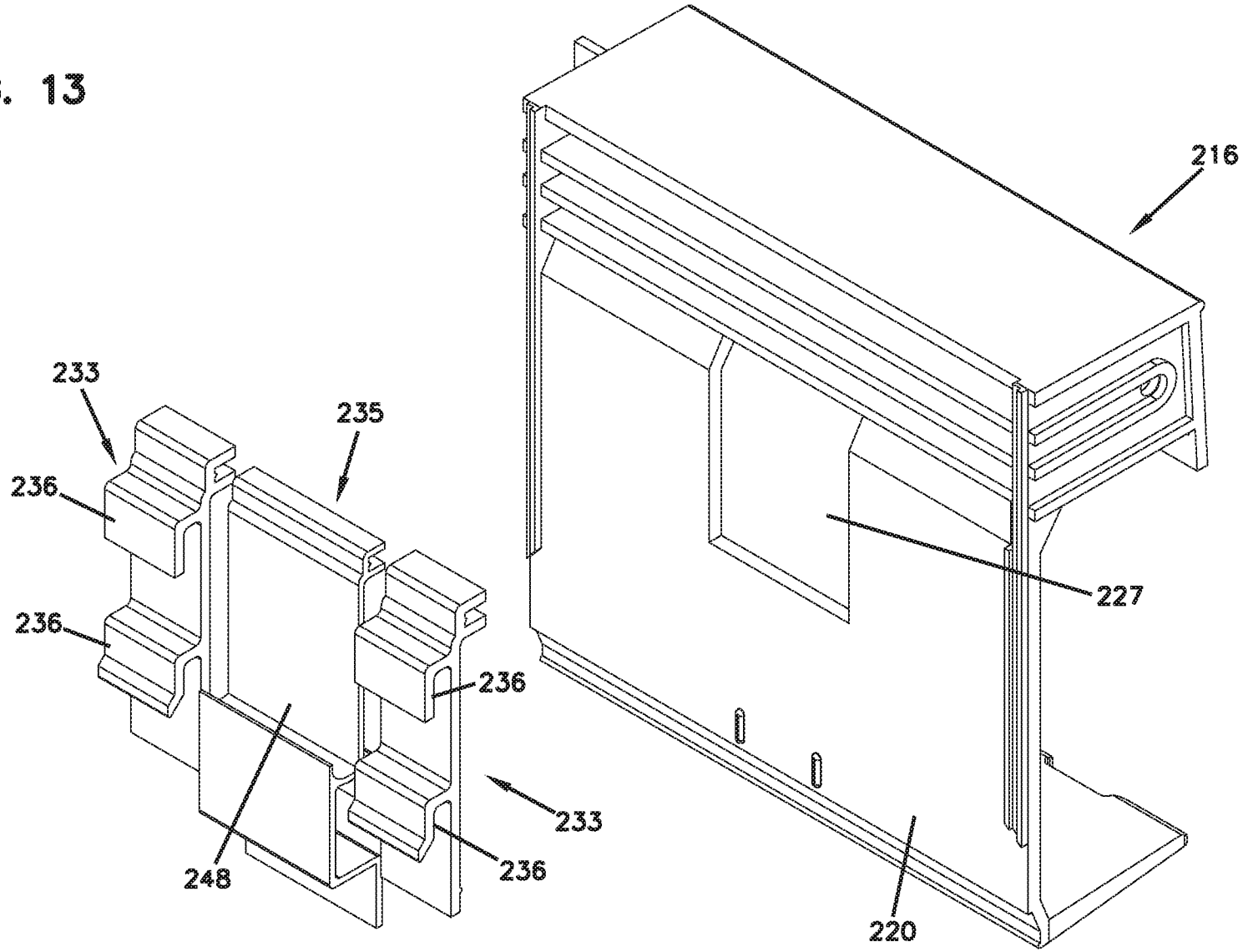
FIG. 13 is a rear perspective view showing the hook-like extensions and the flexible portion separated from the base of the twist-tie dispenser prior to a welding operation.
Figure 14:
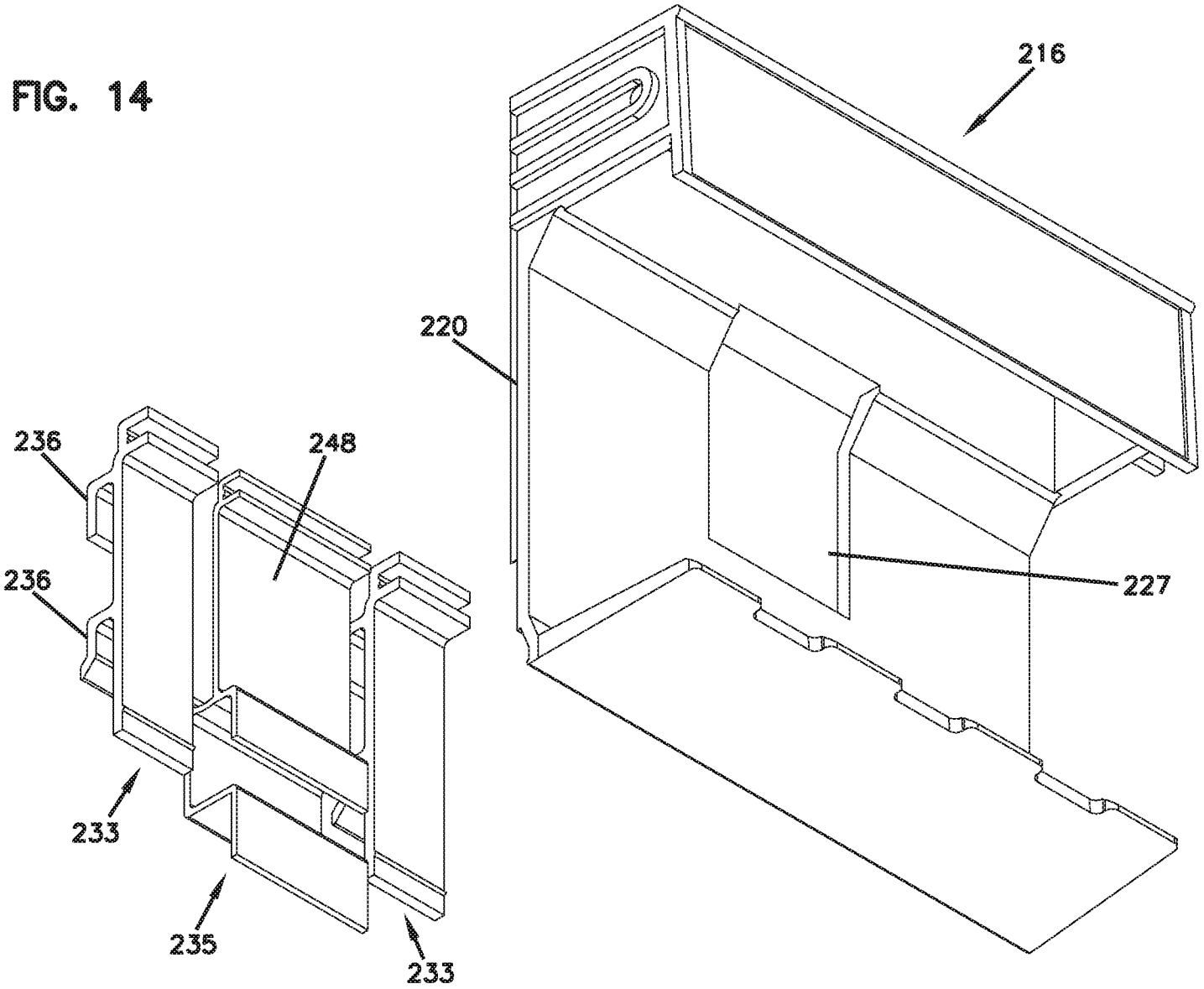
FIG. 14 illustrates the base, the hook-like extensions, and the flexible portion of FIG. 13 from a front perspective view.

FIG. 9 illustrates a base 116 defining an alternative mounting arrangement at the rear wall 120 of the base 116. The mounting features 128 of the base 116 are similar to those of the base 16 of FIGS. 1-8, except that the upper hook-like extension 136 defines a pocket 142 that opens upwardly rather than downwardly. This configuration necessitates a mounting method where the dispenser 110 is initially lifted upwardly, inserting or hooking the upper rod 30 within the pocket 142 of the upper extension 136. The dispenser 110 is then pivoted toward the fixture 12. After the pivoting motion, the dispenser 110 is moved downwardly to insert the lower rod 30 into the pockets 142 of the lower extensions 136 by deflecting the flexible portion 148 out of the way (similar to that of the base 16 of FIGS. 1-8).

FIGS. 10-14 illustrate yet another version of a base 216 having an alternative mounting arrangement at the rear portion 220 of the base 216. The mounting arrangement of the base 216 is similar to those shown for bases 16, 116 in that hook-like extensions 236 and a center flexible portion 248 is used. In the version of FIGS. 10-14, two rows of two extensions 236 each are used. The upper extensions 236, again, are for support and rigidity and the lower extensions 236 are used for latching. The flexible portion 248, in the shown embodiment, defines a single tab 250 that spans the entire width defined between the two lower extensions 236. The center flexible portion 248, as shown in FIGS. 10-14, may be accessed both from the rear 225 of the dispenser 210 and the front 226 of the dispenser 210 when the twist-tie cluster 14 is spent. The flexible portion 248 extends through an opening 227 provided at the rear wall 220 of the base 216 and defines a handle 229 that can be grasped and pulled from the open front 226 of the dispenser 210 for elastically deflecting the flexible portion 248. Upon pulling the handle 229 and deflecting the flexible portion 248, the rod 30 can be cleared from the latching surface 252 of the tab 250 and the dispenser 210 lifted upwardly to remove it from the fixture 12. The flexible portion 248 also defines a stop tab 231 at a lower end thereof to limit opposite rearward deflection of the flexible portion 248 to provide strength to the mounting arrangement.

It should be noted that the mounting arrangement shown in FIGS. 10-14 may be used as a retro-fit measure for dispensers that are not initially provided with the latching structures that have been discussed above. As long as an opening 227 is molded through the rear wall 220 of the base 216, the hook-like extensions 236 and the central flexible portion 248 may be mounted to the rear wall 220 of the base 216 to convert the dispenser to a latching type dispenser 210. The hook-like extensions 236 and the flexible portions 248 may be provided as separate pieces that are ultra-sonically welded (or attached in other ways) to the base 216. Piece parts 233 for the extensions 236 and a piece part 235 for the flexible portion 248 are shown separately from the base 216 (prior to welding) in FIGS. 13-14.

Thus, the hook-like extensions 236 and the flexible portion 248 may provide a conversion structure for converting preexisting non-disposable dispensers to disposable dispensers 210 with minor modification.

The above specification, examples, and data provide a complete description of the manufacture and use of the composition of embodiments of the inventive aspects. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the disclosure. Therefore, it is manifestly intended that the inventive features be limited only by the claims and the equivalents thereof

The invention claimed is:

1. A twist-tie dispenser, comprising:

a base including a top portion defining a twist-tie cluster mounting surface, a rear wall extending downward from the top portion, and an open front;

a latching structure configured for removably mounting the base to a fixture including at least one mounting structure in the form of a rod, the latching structure defined at least in part by a first extension protruding from the rear wall of the base, the first extension defining a pocket formed by an upper stop surface and a vertical retention surface, the latching structure also defined at least in part by a flexible portion of the rear wall that is configured to elastically deflect through a cut-out provided on the rear wall in a direction from the rear wall toward the open front when the mounting structure of the fixture is inserted into the pocket of the first extension, the cut-out extending from a bottom edge of the rear wall upwardly to a vertical location that is positioned higher than the upper stop surface defined by the first extension, the flexible portion also defining a lower stop surface that opposes the upper stop surface of the first extension when the mounting structure is within the pocket of the first extension and is captured between the lower stop surface and the upper stop surface.

2. A twist-tie dispenser according to claim 1, wherein the lower stop surface of the flexible portion is defined by a ramped tab configured to allow the mounting structure of the fixture to slidably move therealong when deflecting the flexible portion.

3. A twist-tie dispenser according to claim 1, wherein the latching structure defines at least two first extensions protruding from the rear wall, the at least two first extensions aligned along a horizontal row.

4. A twist-tie dispenser according to claim 3, wherein the flexible portion of the rear wall is positioned between the at least two first extensions that are aligned along the horizontal row.

5. A twist-tie dispenser according to claim 4, wherein the flexible portion of the rear wall includes at least two ramped tabs corresponding to the at least two first extensions, each ramped tab defining the lower stop surface that opposes the upper stop surface of each first extension, wherein each ramped tab is configured to allow the mounting structure of the fixture to slidably move therealong when deflecting the flexible portion.

6. A twist-tie dispenser according to claim 1, further comprising a second extension protruding from the rear wall, the second extension spaced vertically apart from the first extension and configured to receive a second mounting structure of the fixture that is also in the form of a rod and that is spaced vertically apart from and is parallel to the at least one mounting structure.

7. A twist-tie dispenser according to claim 6, further comprising at least two second extensions protruding from the rear wall, the at least two second extensions aligned along a horizontal row.

8. A twist-tie dispenser according to claim 6, wherein the second extension defines a vertical retention surface and an upper stop surface such that a pocket of the second extension opens downwardly for receiving the second mounting structure of the fixture.

9. A twist-tie dispenser according to claim 6, wherein the second extension defines a vertical retention surface and a lower stop surface such that a pocket of the second extension opens upwardly for receiving the second mounting structure of the fixture.

10. A twist-tie dispenser according to claim 1, wherein the base is mounted to the fixture.

11. The twist-tie dispenser according to claim 1, wherein the base is made of extruded plastic.

12. A twist-tie dispenser, comprising:

a base including a top portion, a rear wall extending downward from the top portion, and an open front;

a latching structure configured for removably mounting the base to a fixture including at least one mounting structure in the form of a rod, the latching structure defined at least in part by a first extension protruding from the rear wall of the base, the first extension defining a pocket formed by an upper stop surface and a vertical retention surface, the latching structure also defined at least in part by a flexible portion of the rear wall that is configured to elastically deflect through a cut-out provided on the rear wall in a direction from the rear wall toward the open front when the mounting structure of the fixture is inserted into the pocket of the first extension, the cut-out extending from a bottom edge of the rear wall upwardly to a vertical location that is positioned higher than the upper stop surface defined by the first extension, the flexible portion also defining a lower stop surface that opposes the upper stop surface of the first extension when the mounting structure is within the pocket of the first extension and is captured between the lower stop surface and the upper stop surface; and a twist-tie cluster mounted to the top portion of the base.

13. A twist-tie dispenser according to claim 12, wherein the base and the twist-tie cluster are secured with a securing member selected from the group consisting of an adhesive, at least one staple, and at least one rivet.

14. A twist-tie dispenser according to claim 12, wherein the latching structure defines at least two first extensions protruding from the rear wall, the at least two first extensions aligned along a horizontal row.

15. A twist-tie dispenser according to claim 14, wherein the flexible portion of the rear wall is positioned between the at least two first extensions that are aligned along the horizontal row.

16. A twist-tie dispenser according to claim 15, wherein the flexible portion of the rear wall includes at least two ramped tabs corresponding to the at least two first extensions, each ramped tab defining the lower stop surface that opposes the upper stop surface of each first extension, wherein each ramped tab is configured to allow the mounting structure of the fixture to slidably move therealong when deflecting the flexible portion.

17. A twist-tie dispenser according to claim 12, further comprising a second extension protruding from the rear wall, the second extension spaced vertically apart from the first extension and configured to receive a second mounting structure of the fixture that is also in the form of a rod and that is spaced vertically apart from and is parallel to the at least one mounting structure.

18. A twist-tie dispenser according to claim 17, further comprising at least two second extensions protruding from the rear wall, the at least two second extensions aligned along a horizontal row.

19. A twist-tie dispenser according to claim 17, wherein the second extension defines a vertical retention surface and an upper stop surface such that a pocket of the second extension opens downwardly for receiving the second mounting structure of the fixture.

20. A twist-tie dispenser according to claim 17, wherein the second extension defines a vertical retention surface and a lower stop surface such that a pocket of the second extension opens upwardly for receiving the second mounting structure of the fixture.

21. A method of using a twist-tie dispenser, the method comprising:

providing a twist-tie dispenser comprising a base including a top portion defining a twist-tie cluster mounting surface, a rear wall extending downward from the top portion, and an open front, the dispenser further comprising a latching structure configured for removably mounting the base to a fixture including at least one mounting structure in the form of a rod, the latching structure defined at least in part by a first extension protruding from the rear wall of the base, the first extension defining a pocket formed by an upper stop surface and a vertical retention surface, the latching structure also defined at least in part by a flexible portion of the rear wall that is configured to elastically deflect through a cut-out provided on the rear wall in a direction from the rear wall toward the open front when the mounting structure of the fixture is inserted into the pocket of the first extension, the cut-out extending from a bottom edge of the rear wall upwardly to a vertical location that is positioned higher than the upper stop surface defined by the first extension, the flexible portion also defining a lower stop surface that opposes the upper stop surface of the first extension when the mounting structure is within the pocket of the first extension and is captured between the lower stop surface and the upper stop surface;

slidably inserting the mounting structure of the fixture into the pocket of the first extension until abutting the upper stop surface;

while slidably inserting the mounting structure of the fixture into the pocket of the first extension, deflecting the flexible portion of the rear wall through the cut-out provided on the rear wall until the mounting structure is captured between the upper stop surface of the first extension and the lower stop surface defined by the flexible portion.

22. A method according to claim 21, wherein the twist-tie dispenser further comprises a twist-tie cluster mounted to the top portion of the base.

23. A method according to claim 21, further comprising removing the twist-tie dispenser from the fixture by re-deflecting the flexible portion through the cut-out provided on the rear wall until the mounting structure of the fixture clears the lower stop surface and lifting the base upwardly relative to the fixture.

* * * * *